US012484683B2

(12) United States Patent
Zhong

(10) Patent No.: US 12,484,683 B2
(45) Date of Patent: Dec. 2, 2025

(54) COSMETIC BOTTLE WITH REPLACEABLE INTERNAL COMPONENTS

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 920 days.

(21) Appl. No.: 17/764,204

(22) PCT Filed: Jul. 28, 2020

(86) PCT No.: PCT/CN2020/104996

§ 371 (c)(1),
(2) Date: Mar. 28, 2022

(87) PCT Pub. No.: WO2021/063095

PCT Pub. Date: Apr. 8, 2021

(65) Prior Publication Data

US 2022/0346526 A1 Nov. 3, 2022

(30) Foreign Application Priority Data

Sep. 30, 2019 (CN) ..... 201921652653.2

(51) Int. Cl.

| | |
|---|---|
| ***A45D 34/04*** | (2006.01) |
| ***A45D 40/26*** | (2006.01) |
| ***B65D 51/32*** | (2006.01) |

(52) U.S. Cl.

CPC ..... *A45D 34/045* (2013.01); *A45D 40/265* (2013.01); *B65D 51/32* (2013.01)

(58) Field of Classification Search

CPC .... A45D 34/045; A45D 34/042; A45D 34/04; A45D 40/265; A45D 40/262;

(Continued)

(56) References Cited

U.S. PATENT DOCUMENTS

| | | | | |
|---|---|---|---|---|
| 2009/0214285 | A1 | 8/2009 | Cho | |
| 2019/0322121 | A1* | 10/2019 | Mazingue | B43K 24/10 |
| 2019/0350342 | A1* | 11/2019 | Mathiez | B65D 51/32 |

FOREIGN PATENT DOCUMENTS

| | | | |
|---|---|---|---|
| CA | 2056390 | A1 | 10/1991 |
| CN | 105361403 | A | 3/2016 |

(Continued)

*Primary Examiner* — Robert J Hicks

(74) *Attorney, Agent, or Firm* — Bayramoglu Law Offices LLC

(57) ABSTRACT

A cosmetic bottle with replaceable internal components includes a cover, two buttons, two inner connecting members, a brush rod, an inner bottle, a clamping ring, and an outer bottle that are coaxially arranged. A first button is placed in a first inner connecting member. The cover is sleeved on the first inner connecting member. One end of the rod body of the brush rod is provided with a head, and the other end of the rod body is fixedly connected to a brush head. The head of the brush rod is inserted into the first inner connecting member. An upper connecting portion of the inner bottle is detachably connected to the head of the brush rod, and a lower connecting portion of the inner bottle is fixedly connected to the clamping ring. A second inner connecting member is fixed in a lower opening end of the outer bottle.

10 Claims, 19 Drawing Sheets

(58) Field of Classification Search
CPC ..... A45D 40/26; B65D 51/32; B65D 51/24; B65D 21/0233; B65D 21/02; B65D 25/14
USPC ..... 220/23.89, 23.87, 23.83, 23.9, 495.01; 206/581; 132/294, 318, 317
See application file for complete search history.

(56) References Cited

FOREIGN PATENT DOCUMENTS

| | | | | | |
|---|---|---|---|---|---|
| CN | 205728629 | U | | 11/2016 | |
| CN | 206852273 | U | | 1/2018 | |
| CN | 108545341 | A | * | 9/2018 | ..... B65D 53/02 |
| CN | 209235151 | U | | 8/2019 | |
| FR | 2853508 | A1 | * | 10/2004 | ..... A45D 40/26 |
| JP | 5263938 | B2 | | 8/2013 | |
| KR | 20160084718 | A | | 7/2016 | |
| WO | 0101813 | A1 | | 1/2001 | |

* cited by examiner

COSMETIC BOTTLE WITH REPLACEABLE INTERNAL COMPONENTS

CROSS REFERENCE TO THE RELATED APPLICATIONS

This application is the national phase entry of International Application No. PCT/CN2020/104996, filed on Jul. 28, 2020, which is based upon and claims priority to Chinese Patent Application No. 201921652653.2, filed on Sep. 30, 2019, the entire contents of which are incorporated herein by reference.

TECHNICAL FIELD

The present invention relates to a cosmetic bottle, and more particularly, relates to a cosmetic bottle with replaceable internal components.

BACKGROUND

In the process of makeup, the prior cosmetic pen is a commonly used tool. Generally, inner cosmetic liquid is used up while outer parts such as a pen cap and a pen holder are still in good condition. It is easy to waste resources by directly discarding the outer parts. Therefore, some cosmetic pens with replaceable material bottles are developed. However, since the bristles are easily damaged or deformed, once the bristles exhibit these problems, the cosmetic pens must still be discarded.

SUMMARY

In order to overcome the above shortcomings, this present invention provides a cosmetic bottle with replaceable internal components. When materials in the cosmetic bottle are used up, one or all of the internal components in the cosmetic bottle can be replaced to meet different user needs.

The following technical solutions are used to solve the technical problems in the present invention:

A cosmetic bottle with replaceable internal components includes a cover, a button, an inner connecting member, a brush rod, an inner bottle, a clamping ring, and an outer bottle that are coaxially arranged. The button includes a first button and a second button, and the inner connecting member includes a first inner connecting member and a second inner connecting member. The first button is placed in the first inner connecting member, and the cover is sleeved on and fixedly connected to the first inner connecting member. The brush rod includes a rod body, one end of the rod body is provided with a head, and the other end of the rod body is fixedly connected to a brush head. The head of the brush rod is inserted into the first inner connecting member, and the head of the brush rod is configured to pop out of the cover by pressing the first button. An upper connecting portion and a lower connecting portion are arranged at two ends of the inner bottle respectively. The upper connecting portion is detachably connected to the head of the brush rod, and the lower connecting portion is fixedly connected to the clamping ring. The second inner connecting member is fixed in a lower opening end of the outer bottle. The second button is placed in the second inner connecting member, the outer bottle is sleeved on an outer side of the inner bottle, the clamping ring extends into the second inner connecting member, and the inner bottle is configured to pop out of the outer bottle by pressing the second button.

Preferably, both an upper end and a lower end of the cover may be opening ends, the upper opening end of the cover may extend radially inward to form a stop ring, and the stop ring may extend downward to form a first stop rod.

Preferably, the button may include a stop portion and an extrusion portion, and an inner side of the extrusion portion may be an inclined surface.

Preferably, the inner connecting member may be a hollow member with openings at both ends, an inner side of the inner connecting member may extend radially inward to form a boss and a clamping rib, and the boss may be located above the clamping rib.

Preferably, a gap may be formed between the head and the rod body of the brush rod, an internal thread may be formed in an inner side of the head, two symmetrical first elastic members may be arranged on an upper end of the head, first hooks may be respectively arranged at heads of the first elastic members, a gap may be formed between the two first hooks, and an outer side of each of the first hooks may be an inclined surface.

Preferably, the upper connecting portion and the lower connecting portion may be arranged at the upper end and the lower end of the inner bottle respectively, and an external thread may be formed in an outer side of the upper connecting portion.

Preferably, the clamping ring may include a mounting portion and a second elastic member, the mounting portion may be sleeved on and fixedly connected to the lower connecting portion of the inner bottle, two symmetrical second elastic members may be arranged on a lower end of the mounting portion, second hooks may be respectively arranged at heads of the second elastic members, a gap may be formed between the two second hooks, and an outer side of each of the second hooks may be an inclined surface.

Preferably, an inner plug may be nested at an inner side of an opening of the upper connecting portion, and the inner plug may be fixed to the upper connecting portion by a snap ring.

Preferably, both an upper end and a lower end of the outer bottle may be opening ends, the lower opening end of the outer bottle may extend radially inward to form a second stop ring, and the second stop ring may extend upward to form a second stop rod.

Preferably, a mounting groove may be formed in the other end of the rod body of the brush rod, the brush head may be fixedly arranged in the mounting groove, and the brush head may be a plastic brush head, an iron wire brush head, a cotton brush head, or an eyeliner brush head.

The beneficial effects of the present invention are as follows: the present invention includes the cover, the button, the inner connecting member, the brush rod, the inner bottle, the clamping ring, and the outer bottle. The inner bottle contains cosmetic materials, the inner bottle is placed inside the outer bottle, the brush rod is placed inside the inner bottle, the cover is sleeved on the outer side of the brush rod, and the brush rod is screwed and sealed on the inner bottle. When the brush rod needs to be replaced, the first button above the brush rod is pressed to remove the old brush rod and replace it with a new one. When the inner bottle needs to be replaced, the second button below the inner bottle is pressed to remove the old inner bottle and replace it with a new one. According to the present invention, the brush rod and the inner bottle can be replaced independently or at the same time as required, so the present invention has simple replacement operation, stronger practical function, and broad application market.

Figure 1:
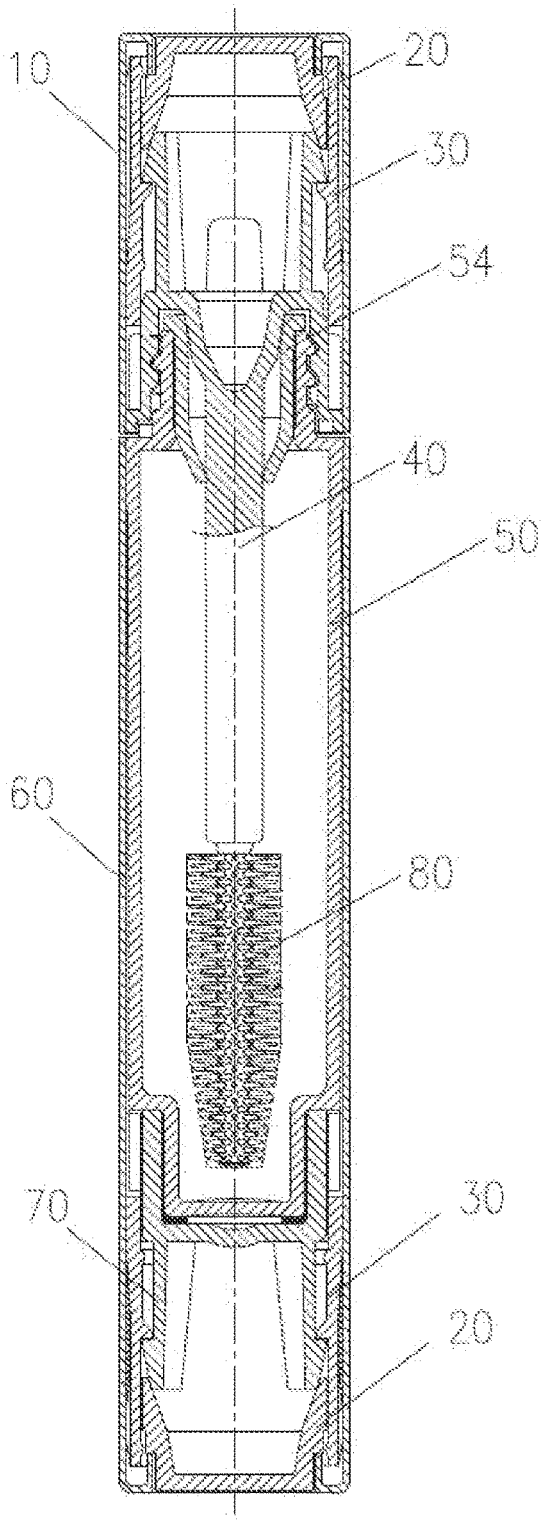
FIG. 1 is a schematic structural diagram of the present invention.

Reference numerals: 10—cover, 11—first stop rod, 20—button, 21—stop portion, 22—extrusion portion, 30—inner connecting member, 31—boss, 32—clamping rib, 40—brush rod, 41—head, 42—internal thread, 43—first elastic member, 44—rod body, 45—mounting groove, 46—first hook, 50—inner bottle, 51—upper connecting portion, 52—external thread, 53—lower connecting portion, 54—inner plug, 60—outer bottle, 61—second stop rod, 70—clamping ring, 71—mounting portion, 72—second elastic member, 73—second hook, 80—brush head, 81—plastic brush head, 82—iron wire brush head, 83—cotton brush head, and 84—eyeliner brush head.

DETAILED DESCRIPTION OF THE EMBODIMENTS

The technical solutions in embodiments of the present invention will be described below clearly and completely with reference to the embodiments of the present invention. Apparently, the described embodiments are merely a part, rather than all of the embodiments of the present invention. All other embodiments derived from the embodiments in the present invention by those of ordinary skill in the art without creative efforts shall fall within the protection scope of the present invention.

It should be noted that the terms "first", "second", and so on in the description and claims of this application and in the above accompanying drawings are intended to distinguish between similar objects but do not necessarily indicate a specific order or sequence. It should be understood that the data used in such a way may be exchanged under proper conditions to make it possible to implement the described implementations of this application in sequences except those illustrated or described herein. Moreover, the terms "include", "contain", and any other variants mean to cover the non-exclusive inclusion, for example, a process, method, system, product, or device that includes a list of steps or units is not necessarily limited to those steps or units which are clearly listed, but may include other steps or units which are not expressly listed or inherent to such a process, method, system, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it is described as a component "above other component or structure" or "on other component or structure". Therefore, the component will be positioned as "below other component or structure" or "under other component or structure". Therefore, the exemplary term "above" may include both orientations "above" and "below". The component may also be positioned in other different ways (rotated by 90 degrees or in other orientations), but the relative description of the space should be explained accordingly.

Embodiment: as shown in FIG. 1 to FIG. 15, a cosmetic bottle with replaceable internal components includes a cover 10, a button 20, an inner connecting member 30, a brush rod 40, an inner bottle 50, a clamping ring 70, and an outer bottle 60 that are coaxially arranged. The button 20 includes a first button and a second button. The inner connecting member 30 includes a first inner connecting member and a second inner connecting member. The first button is placed in the first inner connecting member. The cover 10 is sleeved on and fixedly connected to the first inner connecting member. The brush rod 40 includes a rod body 44. One end of the rod body 44 is provided with a head 41, and the other end of the rod body 44 is fixedly connected to a brush head 80. The head of the brush rod 40 is inserted into the first inner connecting member. The head 41 of the brush rod is configured to pop out of the cover 10 by pressing the first button. An upper connecting portion 51 and a lower connecting portion 53 are arranged at two ends of the inner bottle 50 respectively. The upper connecting portion 51 is detachably connected to the head 41 of the brush rod. The lower connecting portion 53 is fixedly connected to the clamping ring 70. The second inner connecting member is fixed in a lower opening end of the outer bottle 60. The second button is placed in the second inner connecting member. The outer bottle 60 is sleeved on an outer side of the inner bottle 50. The clamping ring 70 extends into the second inner connecting member. The inner bottle is configured to pop out of the outer bottle 60 by pressing the second button.

The shape of the cosmetic bottle is not limited herein, and can be square, round, or various special shapes. The cosmetic bottle is suitable for various liquid cosmetics. From the outside, the cosmetic bottle includes an upper part being the cover 10, and a lower part being the outer bottle 60. The first inner connecting member is fixedly connected into the cover 10. The first inner connecting member and the cover can be fixedly connected by glue. The first button is placed on the upper opening end of the first inner connecting member and is limited in the cover 10. The brush rod 40 is located below the first button. The first button and the brush rod are in contact with each other. The first button can move up and down along the first inner connecting member. When the first button is pressed, the brush rod 40 moves downward as a whole and protrudes from the cover 10. The brush rod 40 is pulled out from the cover by holding the protruding part of the brush rod. The inner bottle 50 is used for storing cosmetic materials. The clamping ring 70 is sleeved on the outer side of the lower connecting portion 53 at the lower end of the inner bottle. The clamping ring and the lower connecting portion are fixedly connected by glue. The second inner connecting member is placed at the lower opening end of the outer bottle 60. The second inner connecting member is placed head down at the lower end of the outer bottle. The second inner connecting member and the outer bottle are fixedly connected by glue. The second button is arranged at the opening end of the second inner connecting member. The second button is stopped in the outer bottle. The inner bottle 50 is loaded into the outer bottle 60, and the clamping ring 70 is inserted into the second inner connecting member and is in contact with the second button. When the second button is pressed, the second button pushes the inner bottle 50 to move upward to protrude from the outer bottle 60, and the inner bottle is taken out from the outer bottle by holding the protruding part of the inner bottle. Therefore, in the present invention, the internal components in contact with the materials, that is, the brush rod and the inner bottle, can be replaced. If the cosmetic materials in the old and new inner bottles are the same, it is only necessary to replace the inner bottle, and other components can be used repeatedly. If the brush rod is damaged, it is only necessary to replace the brush rod. If the cosmetic materials used are different, the brush rod and the inner bottle can be both replaced, so the present invention can meet various use needs, and has stronger practicability and wider application range.

Figure 2:
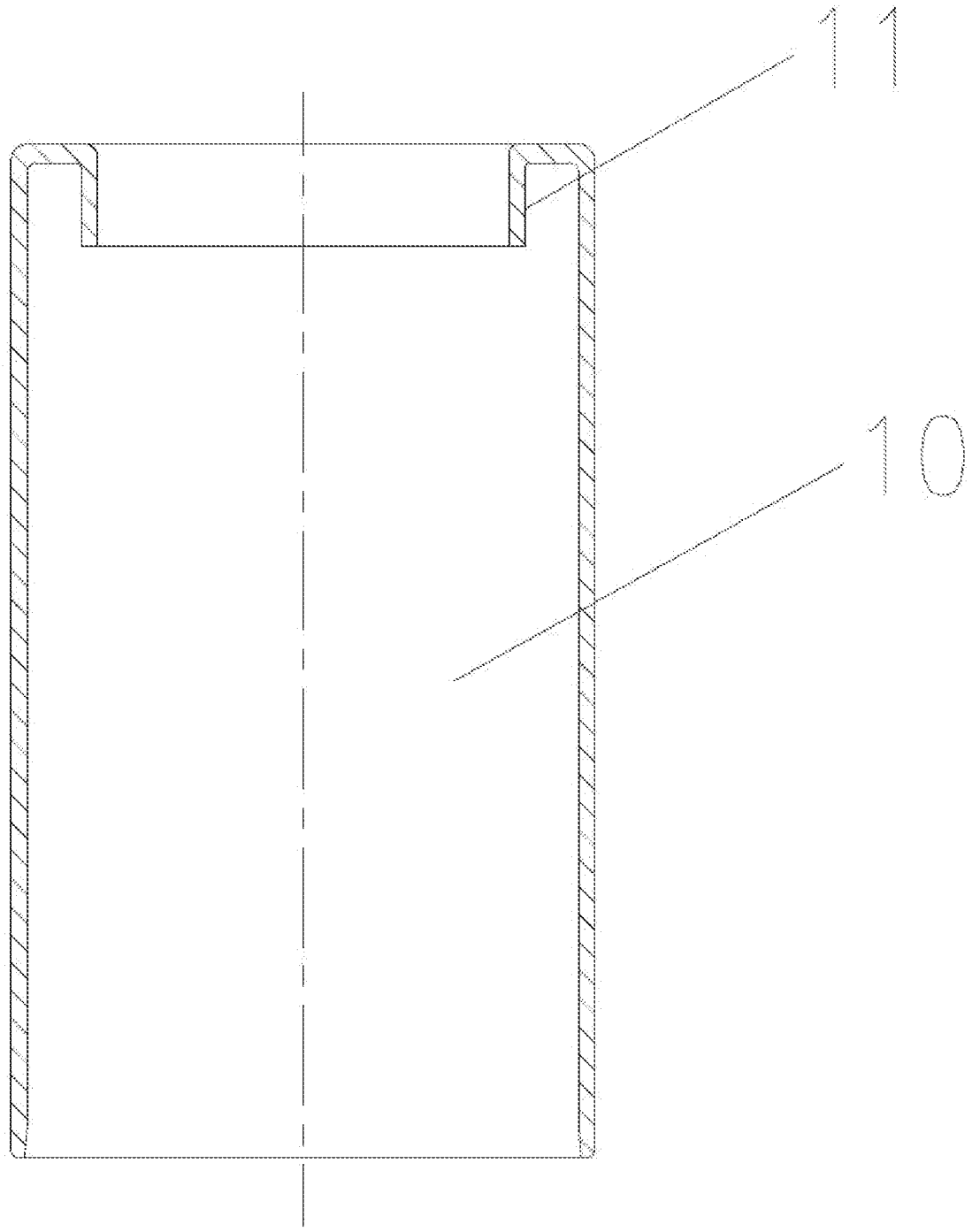
FIG. 2 is a schematic structural diagram of a cover of the present invention.
Figure 3:
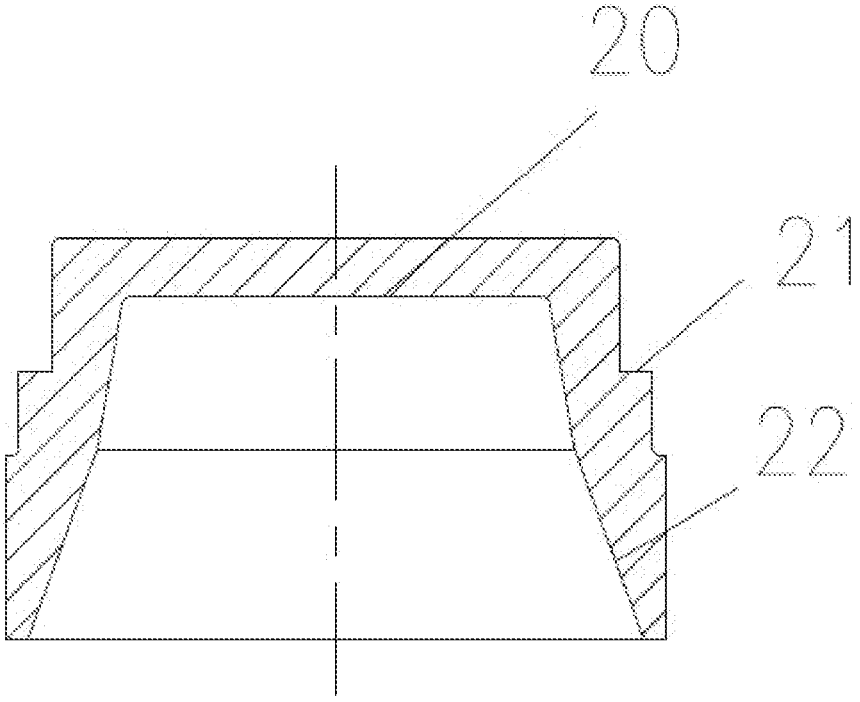
FIG. 3 is a schematic structural diagram of a button of the present invention.

As shown in FIG. 2 and FIG. 3, both an upper end and a lower end of the cover 10 are opening ends, the upper opening end of the cover 10 extends radially inward to form a stop ring, and the stop ring extends downward to form a first stop rod 11. The first stop rod 11 is parallel to the cover, a certain gap is formed therebetween, and the upper end of the first inner connecting member is inserted into the gap. The button 20 includes a stop portion 21 and an extrusion portion 22, and an inner side of the extrusion portion 22 is an inclined surface. Under normal conditions, the stop portion 21 on the first button abuts against the inner side of the first stop rod 11 on the cover, and the first button is restrained in the cover. The upper end of the cover is an opening end, so the first button can be directly pressed from the upper end of the cover.

Figure 4:
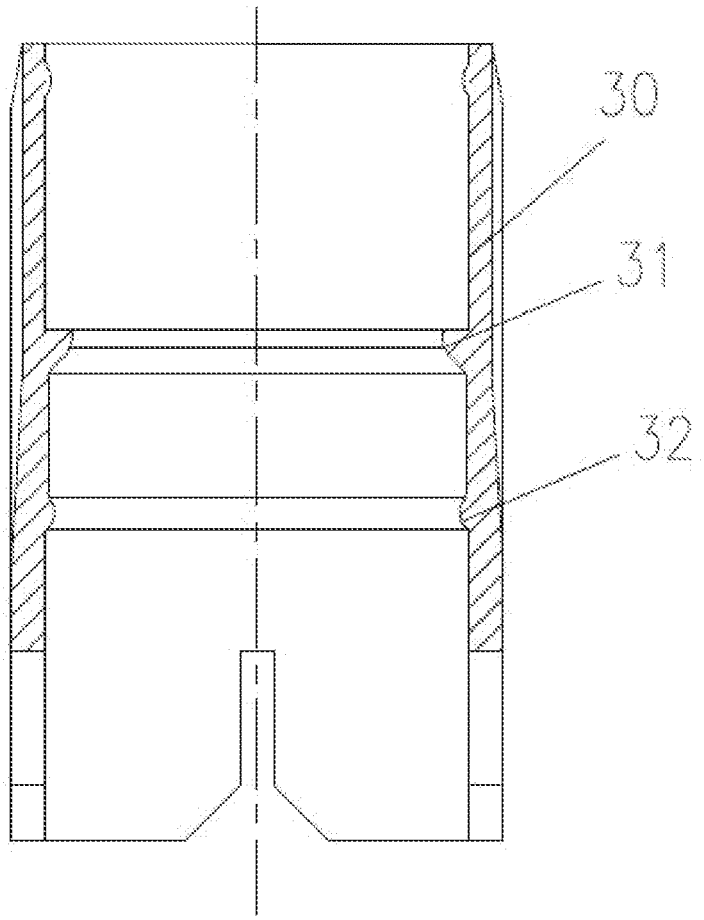
FIG. 4 is a schematic structural diagram of an inner connecting member of the present invention.
Figure 5:
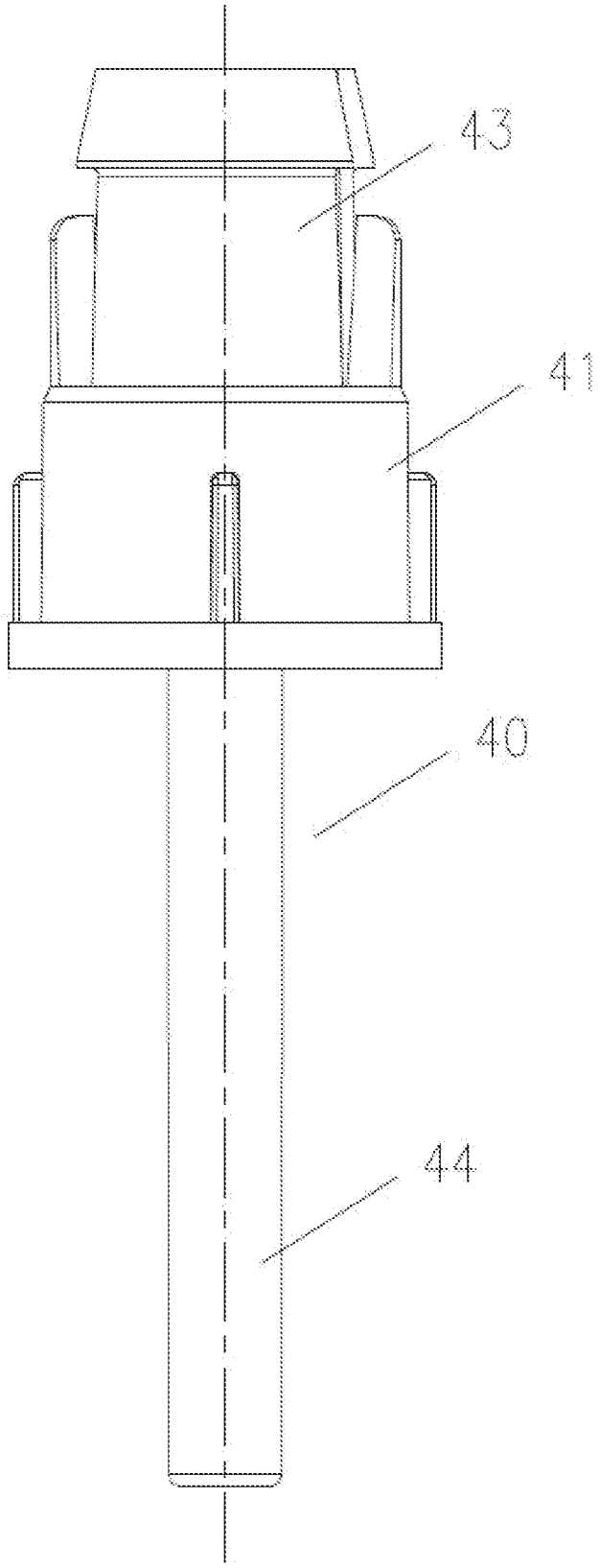
FIG. 5 is a schematic structural diagram of a brush rod of the present invention.
Figure 6:
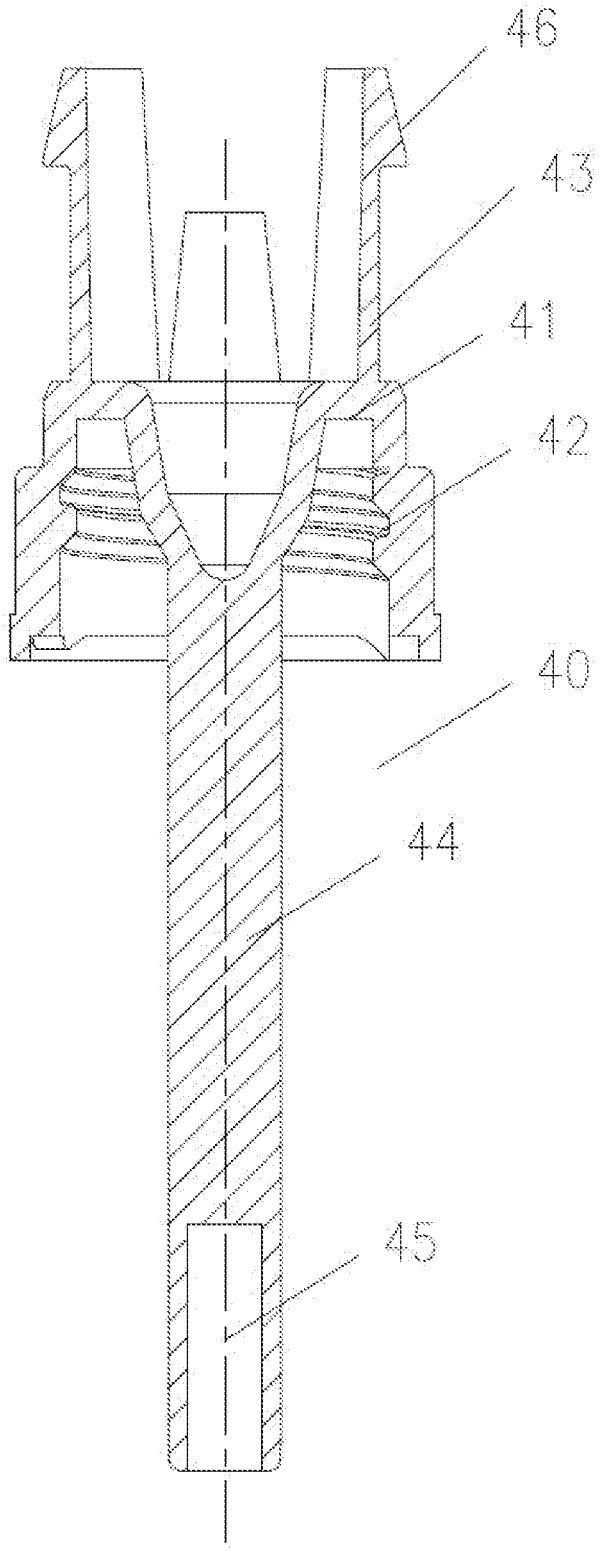
FIG. 6 is a sectional view of the brush rod of the present invention.

As shown in FIG. 4 to FIG. 6, the inner connecting member 30 is a hollow member with openings at both ends, an inner side of the inner connecting member 30 extends radially inward to form a boss 31 and a clamping rib 32, and the boss 31 is located above the clamping rib 32. A gap is formed between the head 41 and the rod body 44 of the brush rod, an internal thread 42 is formed in an inner side of the head, two symmetrical first elastic members 43 are arranged on an upper end of the head 41, first hooks 46 are respectively arranged at heads of the first elastic members 43, a gap is formed between the two first hooks 46, and an outer side of each of the first hooks 46 is an inclined surface. The boss on the first inner connecting member is used to limit the first hook on the first elastic member of the brush rod. Under normal conditions, the first hook 46 on the first elastic member is stopped by the boss, the first hook is placed in the first button, and its inclined surface abuts against the inclined surface of the extrusion portion of the first button. When the first button is pressed, the inclined surface of the first button applies pressure to the inclined surface of the first hook, such that the two first hooks move inward, then the first hooks slide out of the boss, and the brush rod 40 can move downward. When moving to the clamping rib 32, the first hook is blocked by the clamping rib, the head of the brush rod has protruded from the lower opening end of the cover, and the brush rod is directly pulled out, so the clamping rib here acts as a buffer to prevent the brush rod from directly popping out of the cover under the action of the button. After the old brush rod is taken out, a new one is loaded so as to complete the replacement of the brush rod. The specific principle of extruding the brush rod by the first button is as follows: a gap is formed between the first hook on the first elastic member 43 and the inner wall of the first inner connecting member, the first button is inserted into the gap, and the inclined surface of the first button fits the inclined surface of the first hook 46. Therefore, when the first button is pressed downward, the two inclined surfaces are pressed together to apply horizontal component force to the first hook, such that the two first hooks are compressed inward and slide over the boss 31 of the first inner connecting member.

Figure 7:
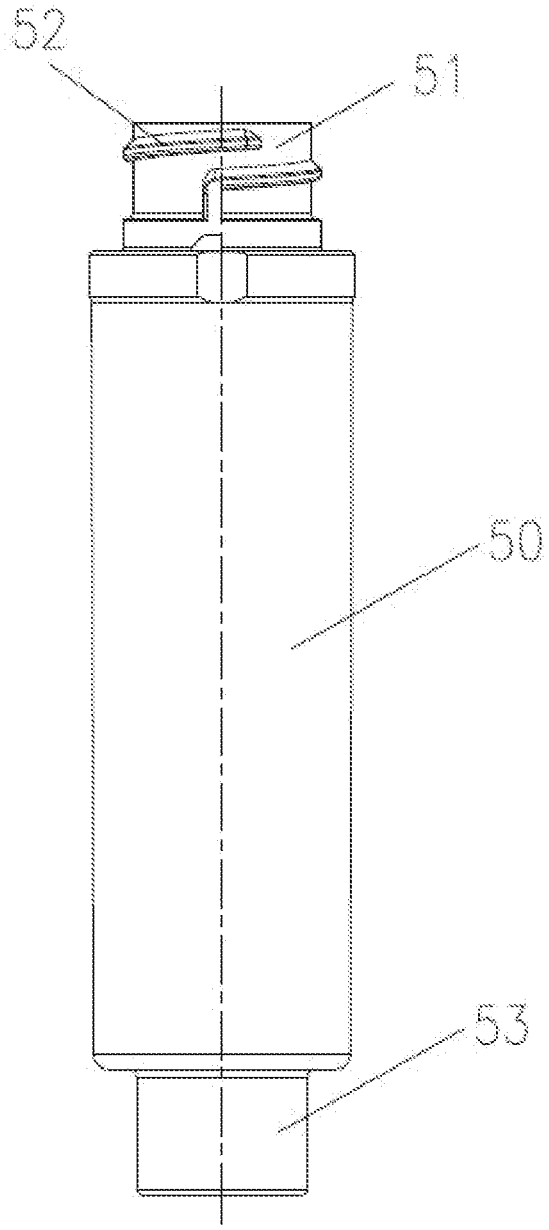
FIG. 7 is a schematic structural diagram of an inner bottle of the present invention.
Figure 8:
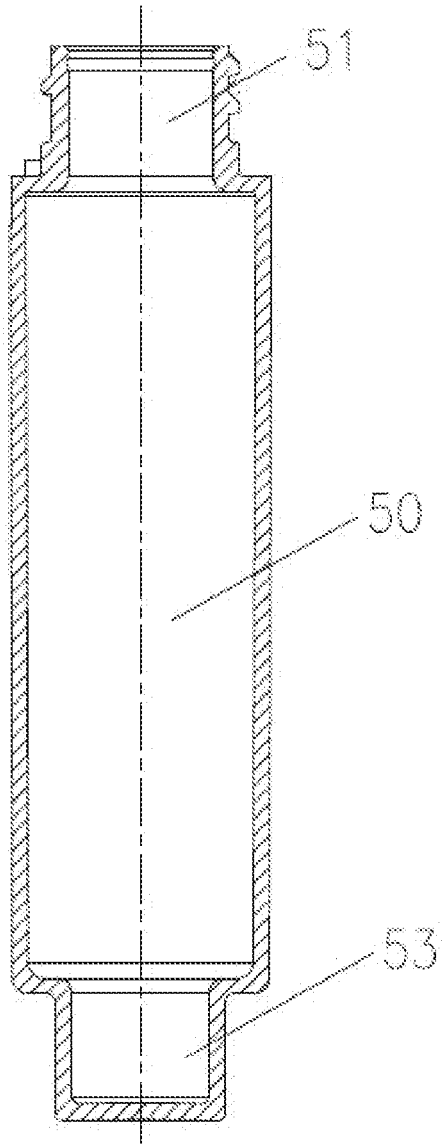
FIG. 8 is a sectional view of the inner bottle of the present invention.
Figure 9:
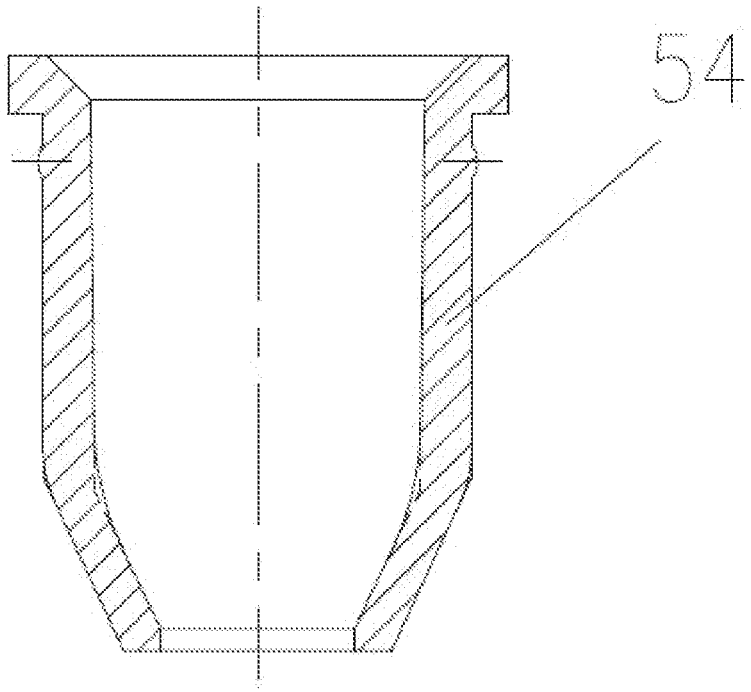
FIG. 9 is a schematic structural diagram of an inner plug of the present invention.

As shown in FIG. 7 and FIG. 8, the upper connecting portion 51 and the lower connecting portion 53 are arranged at the upper end and the lower end of the inner bottle 50 respectively, and an external thread 52 is formed in an outer side of the upper connecting portion 51. During assembly, the upper connecting portion of the inner bottle is inserted into the gap between the head and the rod body of the brush rod, and is screwed with the internal thread on the brush rod through the external thread, and the inner bottle is used for filling cosmetic materials. An inner plug 54 is nested at an inner side of an opening of the upper connecting portion 51, and the inner plug is fixed to the upper connecting portion by a snap ring. A circular snap ring is arranged on the outer side of the inner plug, and a circular groove is formed in the inner side of the inner bottle. When the inner plug is nested in the inner bottle, the snap ring is snapped into the groove to seal the inner bottle and the inner plug.

Figure 11:
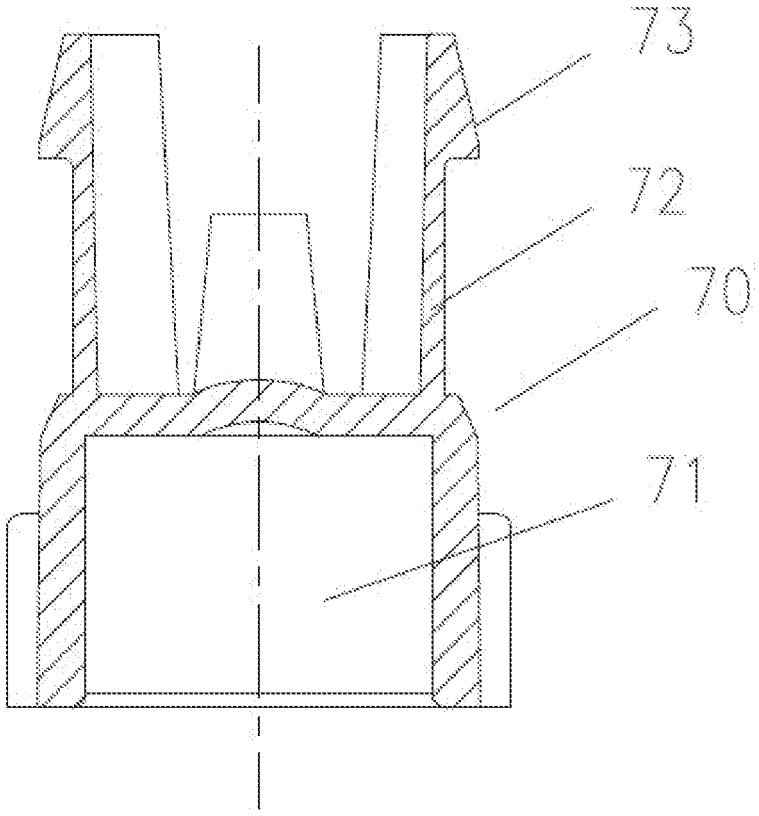
FIG. 11 is a schematic structural diagram of a clamping ring of the present invention.
Figure 12:
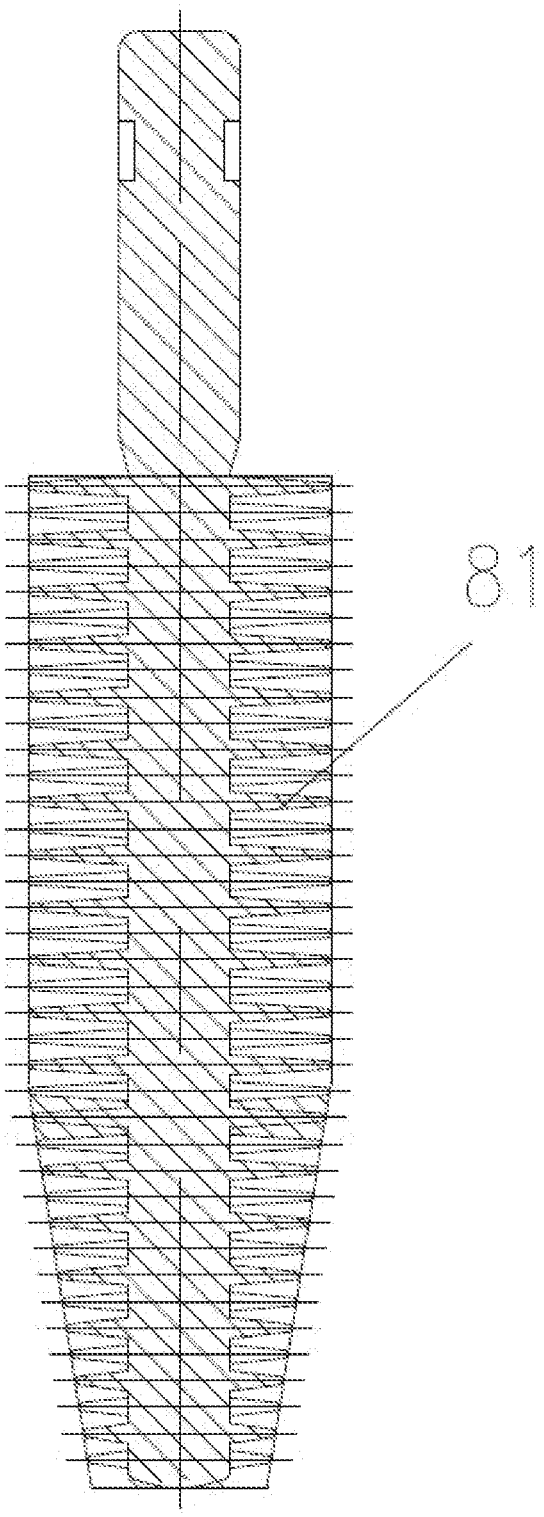
FIG. 12 is a schematic structural diagram of a plastic brush head of the present invention.
Figure 13:
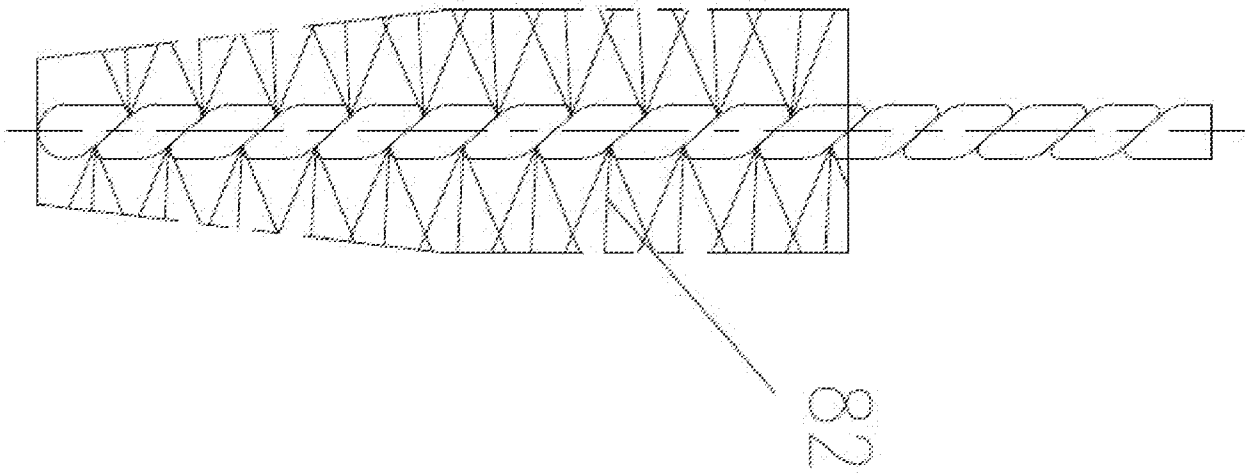
FIG. 13 is a schematic structural diagram of an iron wire brush head of the present invention.
Figure 14:
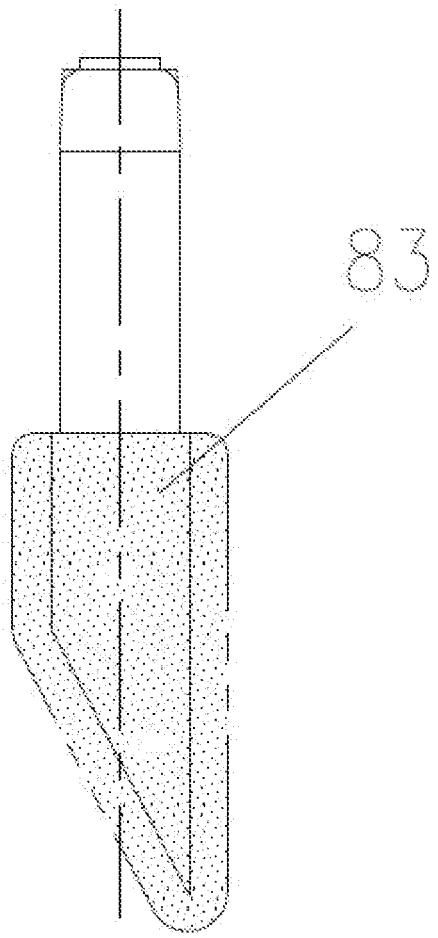
FIG. 14 is a schematic structural diagram of a cotton brush head of the present invention.
Figure 15:
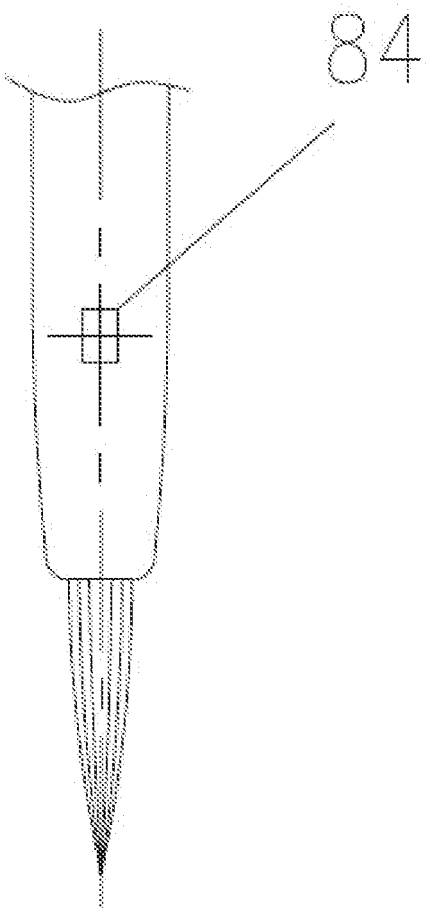
FIG. 15 is a schematic structural diagram of an eyeliner brush head of the present invention.
Figure 16:
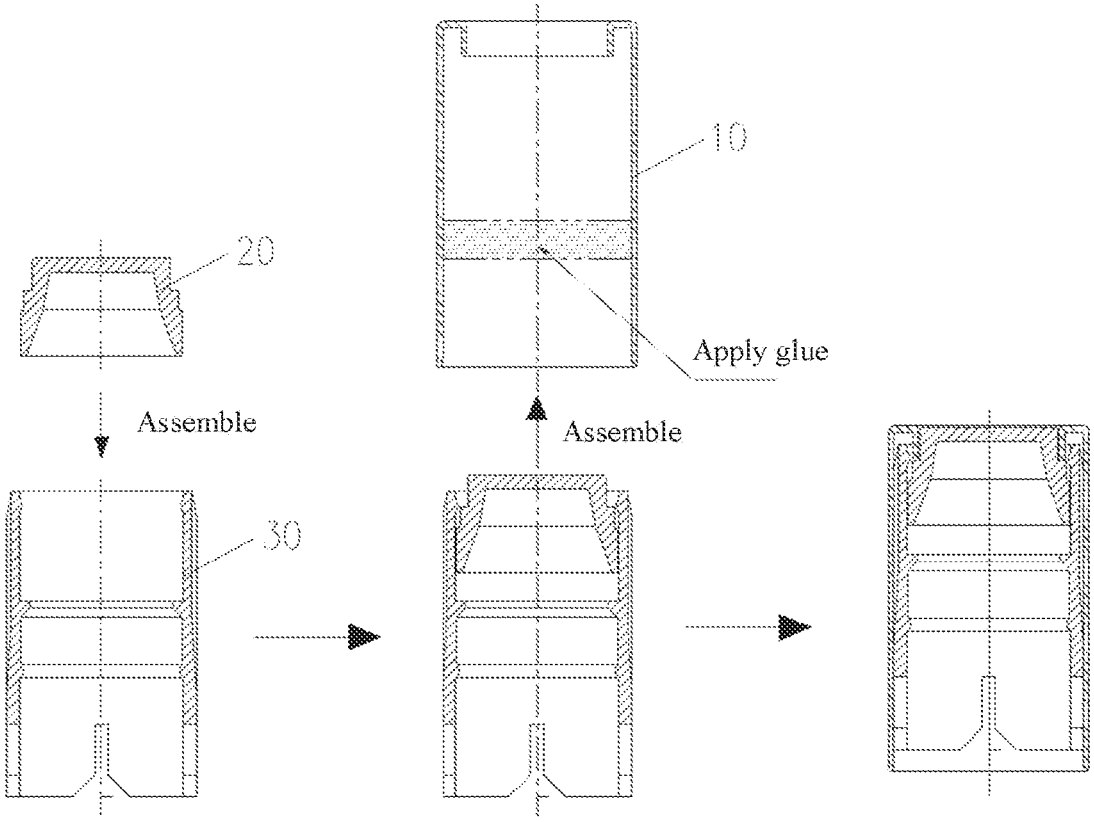
FIG. 16 is an assembly diagram of a first pressing subassembly of the present invention.
Figure 17:
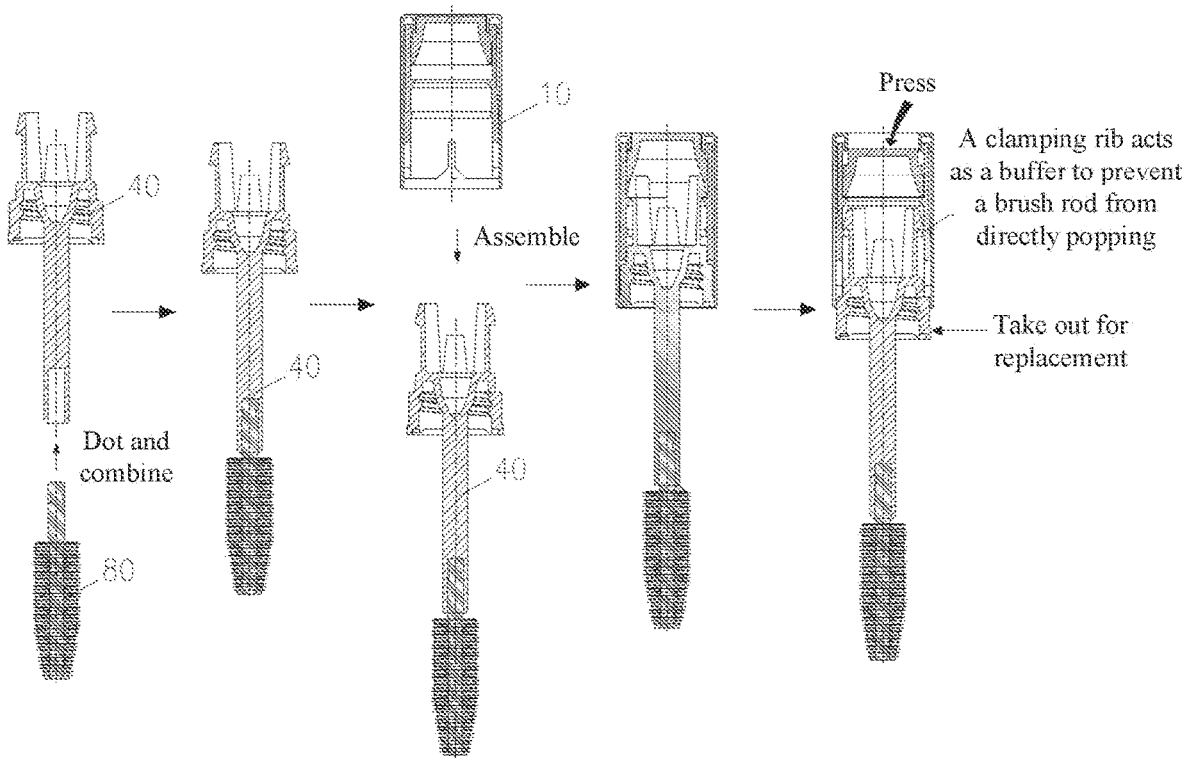
FIG. 17 is an assembly diagram of a brush rod subassembly of the present invention.
Figure 18:
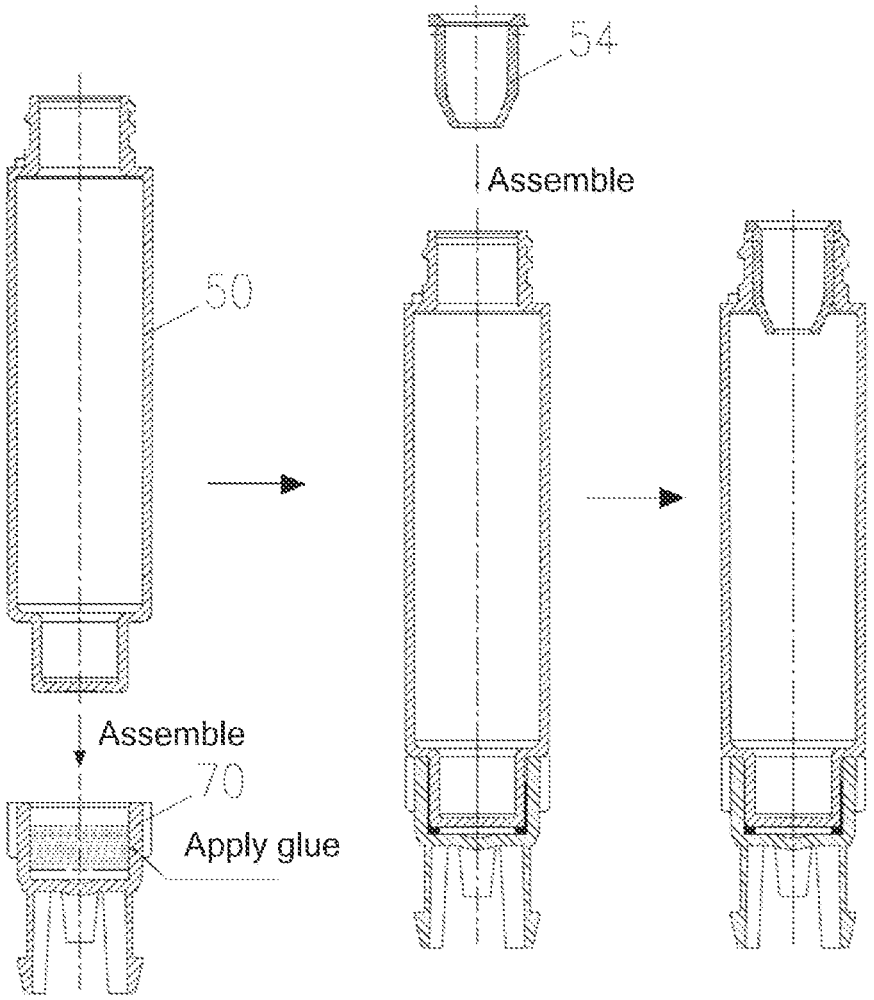
FIG. 18 is an assembly diagram of an inner bottle subassembly of the present invention.
Figure 19:
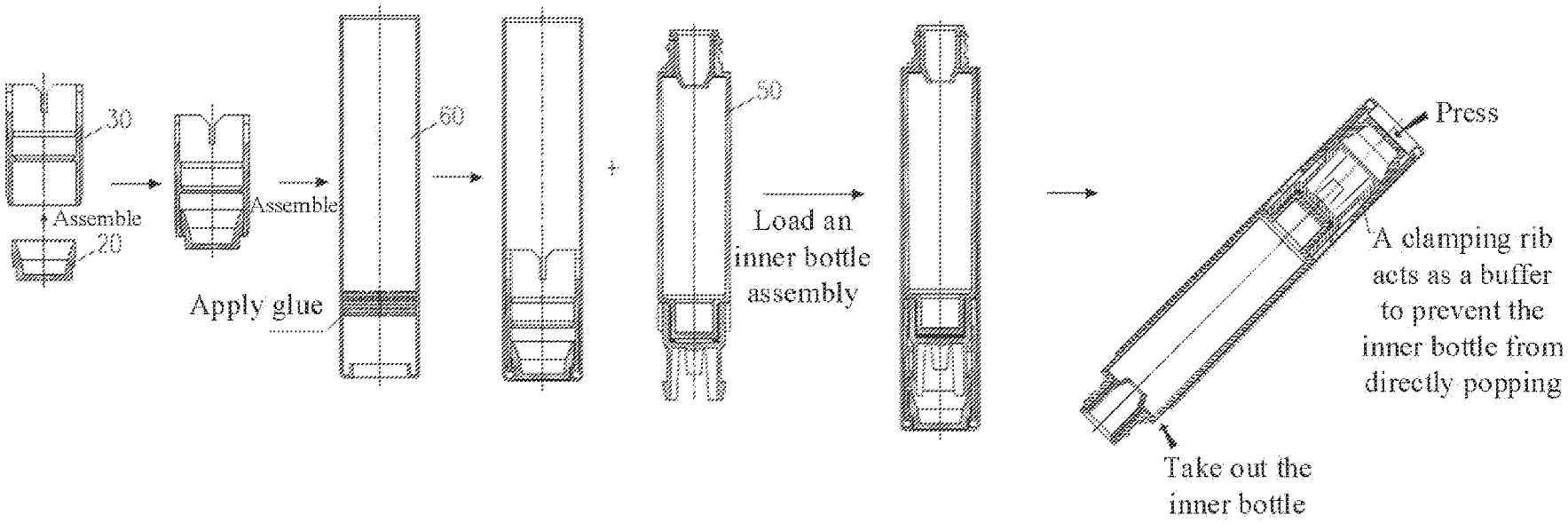
FIG. 19 is an assembly diagram of a bottle body subassembly of the present invention.

As shown in FIG. 11, the clamping ring 70 includes a mounting portion 71 and a second elastic member 72, the mounting portion 71 is sleeved on and fixedly connected to the lower connecting portion 53 of the inner bottle, two symmetrical second elastic members 72 are arranged on a lower end of the mounting portion 71, second hooks 73 are respectively arranged at heads of the second elastic members 72, a gap is formed between the two second hooks 73, and an outer side of each of the second hooks 73 is an inclined surface. Specifically, the mounting portion is fixedly connected to the lower connecting portion by glue, and the boss 31 on the second inner connecting member is used to limit the second hook 73 on the second elastic member of the clamping ring. Under normal conditions, the second hook is stopped by the boss, the second hook is placed in the second button, and its inclined surface abuts against the inclined surface of the extrusion portion of the second button. When the second button is pressed, the inclined surface of the second button applies pressure to the inclined surface of the second hook, such that the two second hooks move inward, then the second hooks slide out of the boss, and the inner bottle 50 can move upward. When moving to the clamping rib 32, the second hook is blocked by the clamping rib, the upper connecting portion of the inner bottle has protruded from the upper opening end of the outer bottle, and the inner bottle is directly pulled out, so the clamping rib here acts as a buffer to prevent the inner bottle from directly popping out of the outer bottle under the action of the second button. After the old inner bottle is taken out, a new one is loaded, so as to complete the replacement of the inner bottle. The specific principle of extruding the clamping ring by the second button is as follows: a gap is formed between the second hook 73 and the inner wall of the second inner connecting member, the second button is inserted into the gap, and the inclined surface of the second button fits the inclined surface of the second hook 73. Therefore, when the second button is pressed upward, the two inclined surfaces are pressed together to apply horizontal component force to the second hook, such that the two second hooks are compressed inward and slide over the boss 31 of the second inner connecting member.

Figure 10:
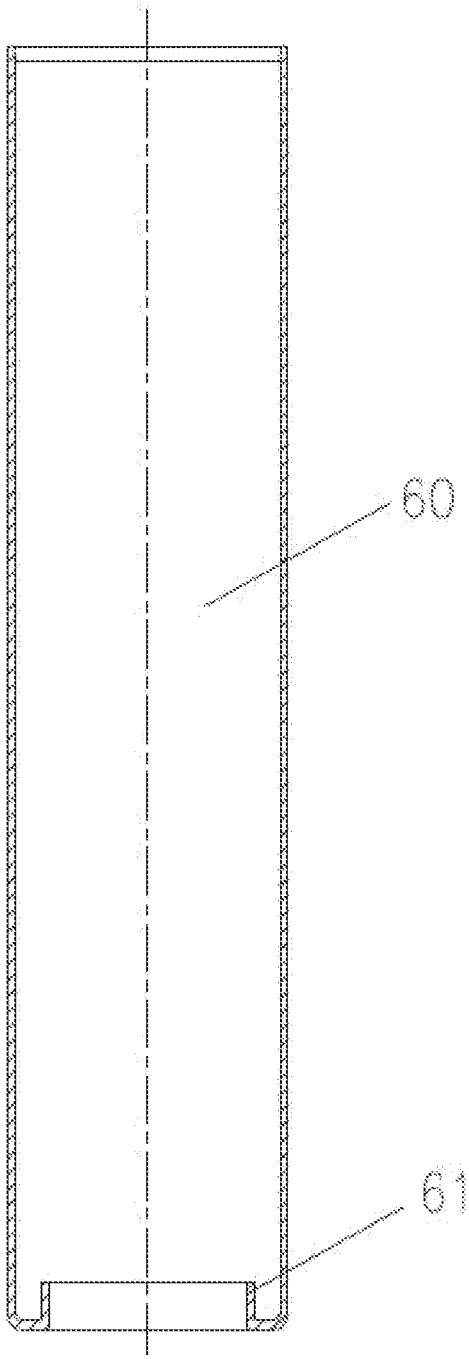
FIG. 10 is a schematic structural diagram of an outer bottle of the present invention.

As shown in FIG. 10, both an upper end and a lower end of the outer bottle 60 are opening ends, the lower opening end of the outer bottle 60 extends radially inward to form a second stop ring, and the second stop ring extends upward to form a second stop rod 61. The second stop rod 61 is parallel to the outer bottle, a certain gap is formed therebetween, and the upper end of the second inner connecting member is inserted into the gap. Under normal conditions, the stop portion 21 on the second button abuts against the inner side of the second stop rod 61 on the outer bottle, and the second button is restrained in the outer bottle. The lower end of the outer bottle is an opening end, so the second button can be directly pressed from the lower end of the outer bottle.

As shown in FIG. 5 and FIG. 12 to FIG. 15, a mounting groove 45 is formed in the other end of the rod body 44 of the brush rod, the brush head 80 is fixedly arranged in the mounting groove 45, and the brush head is a plastic brush head 81, an iron wire brush head 82, a cotton brush head 83, or an eyeliner brush head 84. Therefore, the cosmetic bottle can be applied to water-based liquid cosmetics such as essence and eyeliner, or oily liquid cosmetics such as essential oil and lip oil, and is widely used.

An operation process of the cosmetic bottle is as follows: as shown in FIG. 16 to FIG. 19, the arrows in the figures indicate the direction of assembly or action, and the steps are as follows.

S1: the first button is loaded from the upper opening end of the first inner connecting member, then the inside of the cover 10 is glued, and then the first inner connecting member is loaded from the lower opening end of the cover, such that the cover and the first inner connecting member are fixedly connected by glue, and the upper end of the first button is flush with the upper end of the cover, so as to obtain a first pressing subassembly.

S2: the brush head 80 is fixed in the mounting groove 45 of the brush rod, and then the brush rod is inserted into the first pressing subassembly, such that the first hook 46 on the first elastic member 43 of the brush rod passes over the boss 31 of the first inner connecting member, its inclined surface abuts against the inclined surface of the first button, and the first hook is supported by the boss, so as to obtain a brush rod subassembly.

S3: glue is applied on the inner side of the mounting portion 71 of the clamping ring, and the lower connecting portion 53 of the inner bottle is inserted into the mounting portion, such that the clamping ring and the inner bottle are fixedly connected by glue. Then the inner plug 54 is loaded into the opening end of the upper connecting portion of the inner bottle, so as to obtain an inner bottle subassembly.

S4: the second button is loaded from the upper opening end of the second inner connecting member, glue is applied on the inner side of the outer bottle 60 near the lower opening end, and then the second inner connecting member is loaded into the outer bottle head down, such that the second inner connecting member and the outer bottle are fixedly connected by glue, and the upper end of the second button is flush with the lower end of the outer bottle, so as to obtain a second pressing subassembly.

S5: the inner bottle subassembly is loaded from the upper opening end of the outer bottle, such that the second hook of the second elastic member 72 of the clamping ring passes over the boss 31 of the second inner connecting member, its inclined surface abuts against the inclined surface of the second button, and the second hook is fixed by the boss, so as to obtain a whole bottle assembly.

S6: finally, the brush rod 40 is loaded into the inner bottle 50, and the external thread 52 on the inner bottle is screwed and fixed with the internal thread 42 on the brush rod for use.

S7: when in use, the first pressing subassembly and the brush rod subassembly are screwed off, and the brush head 80 on the brush rod are used for makeup.

S8: when the cosmetic materials in the inner bottle are used up, the first pressing subassembly and the brush rod subassembly are screwed off, the first button is pressed to make the brush rod protrude from the cover 10, then the brush rod is pulled out forcefully, and a new brush rod is loaded. The first button can be restored to its original position under the action of the brush rod during assembly. The second button is pressed to make the inner bottle subassembly protrude from the outer bottle, then the outer bottle is pulled out forcefully, and a new inner bottle subassembly is loaded. The second button can be restored to its original position under the action of the inner bottle subassembly during assembly.

It should be pointed out that several variations and improvements may be made by those of ordinary skill in the art without departing from the conception of the present invention, but such variations and improvements should fall within the protection scope of the present invention. Therefore, the patent protection scope of the present invention should be subject to the appended claims.

What is claimed is:

1. A cosmetic bottle with replaceable internal components, comprising a cover, a button, an inner connecting member, a brush rod, an inner bottle, a clamping ring, and an outer bottle, wherein the cover, the button, the inner connecting member, the brush rod, the inner bottle, the clamping ring, and the outer bottle that are coaxially arranged, wherein the button comprises a first button and a second button, the inner connecting member comprises a first inner connecting member and a second inner connecting member, the first button is placed in the first inner connecting member, the cover is sleeved on and fixedly connected to the first inner connecting member, the brush rod comprises a rod body, a first end of the rod body is provided with a head, and a second end of the rod body is fixedly connected to a brush head, the head of the brush rod is inserted into the first inner connecting member, the head of the brush rod is configured to pop out of the cover by pressing the first button, an upper connecting portion and a lower connecting portion are arranged at an upper end and a lower end of the inner bottle respectively, the upper connecting portion is detachably connected to the head of the brush rod, the lower connecting portion is fixedly connected to the clamping ring, the second inner connecting member is fixed in a lower opening end of the outer bottle, the second button is placed in the second inner connecting member, the outer bottle is sleeved on an outer side of the inner bottle, the clamping ring extends into the second inner connecting member, and the inner bottle is configured to pop out of the outer bottle by pressing the second button.

2. The cosmetic bottle according to claim 1, wherein an upper end and a lower end of the cover are an upper opening end and a lower opening end respectively, the upper opening end of the cover extends radially inward to form a stop ring, and the stop ring extends downward to form a first stop rod.

3. The cosmetic bottle according to claim 1, wherein the button comprises a stop portion and an extrusion portion, and an inner side of the extrusion portion is an inclined surface.

4. The cosmetic bottle according to claim 1, wherein the inner connecting member is a hollow member with openings at both ends, an inner side of the inner connecting member extends radially inward to form a boss and a clamping rib, and the boss is located above the clamping rib.

5. The cosmetic bottle according to claim 1, wherein a first gap is formed between the head and the rod body of the brush rod, an internal thread is formed in an inner side of the head, two symmetrical first elastic members are arranged on an upper end of the head, two first hooks are respectively arranged at heads of the two symmetrical first elastic members, a second gap is formed between the two first hooks, and an outer side of each of the two first hooks is an inclined surface.

6. The cosmetic bottle according to claim 1, wherein the upper connecting portion and the lower connecting portion are arranged at the upper end and the lower end of the inner bottle respectively, and an external thread is formed in an outer side of the upper connecting portion.

7. The cosmetic bottle according to claim 6, wherein the clamping ring comprises a mounting portion and a two symmetrical second elastic members, the mounting portion is sleeved on and fixedly connected to the lower connecting portion of the inner bottle, the two symmetrical second elastic members are arranged on a lower end of the mounting portion, two second hooks are respectively arranged at heads of the second elastic members, a gap is formed between the two second hooks, and an outer side of each of the two second hooks is an inclined surface.

8. The cosmetic bottle according to claim 6, wherein an inner plug is nested at an inner side of an opening of the upper connecting portion, and the inner plug is fixed to the upper connecting portion by a snap ring.

9. The cosmetic bottle according to claim 1, wherein an upper end and a lower end of the outer bottle are an upper opening end and the lower opening end respectively, the lower opening end of the outer bottle extends radially inward to form a second stop ring, and the second stop ring extends upward to form a second stop rod.

10. The cosmetic bottle according to claim 1, wherein a mounting groove is formed in the second end of the rod body of the brush rod, the brush head is fixedly arranged in the mounting groove, and the brush head is a plastic brush head, an iron wire brush head, a cotton brush head, or an eyeliner brush head.

* * * * *